United States Patent [19]

Cooper

[11] Patent Number: 4,954,167

[45] Date of Patent: Sep. 4, 1990

[54] DISPERSING GAS INTO MOLTEN METAL

[76] Inventor: Paul V. Cooper, 8389 Sherman Rd., Chesterland, Ohio 44026

[21] Appl. No.: 377,484

[22] Filed: Jul. 10, 1989

Related U.S. Application Data

[62] Division of Ser. No. 222,934, Jul. 22, 1988, Pat. No. 4,898,367.

[51] Int. Cl.[5] ..... C22B 9/00

[52] U.S. Cl. ..... 75/708; 75/680; 266/225

[58] Field of Search ..... 75/61, 93 R; 266/216

[56] References Cited

U.S. PATENT DOCUMENTS

| | | | |
|---|---|---|---|
| 2,290,961 | 7/1942 | Heuer | 13/23 |
| 2,677,609 | 5/1954 | Moore et al. | 75/53 |
| 3,227,547 | 1/1966 | Szekely | 75/59 |
| 3,785,632 | 1/1974 | Kraemer et al. | 75/61 |
| 3,814,400 | 6/1974 | Seki | 266/1 R |
| 3,839,019 | 10/1974 | Bruno et al. | 75/68 R |
| 3,871,872 | 3/1975 | Downing | 75/61 |
| 3,915,694 | 10/1975 | Ryo | 75/61 |
| 4,018,598 | 4/1977 | Markus | 75/61 |
| 4,372,541 | 2/1983 | Bocourt | 75/61 |
| 4,392,888 | 7/1983 | Eckert et al. | 75/68 R |
| 4,611,790 | 9/1986 | Otsuka et al. | 266/235 |
| 4,634,105 | 1/1976 | Withers et al. | 266/217 |
| 4,717,540 | 1/1988 | MacRae | 75/61 |
| 4,743,428 | 5/1988 | MacRae | 75/61 |

OTHER PUBLICATIONS

Lufi-Hi Tech Brochure (date unknown) Luftfiltrering A/S.

Paper No. 87-83, Practical Observations Rotary Impeller Degassing, A. R. Anderson-American Foundrymen's Society, Inc.

*Primary Examiner*—Peter D. Rosenberg

[57] ABSTRACT

Gas is dispersed into molten metal by immersing a shaft-supported impeller into the molten metal and by pumping gas through the shaft and out of the impeller. The impeller is in the form of a rectangular prism having sharp-edged corners that shear the gas into finely divided bubbles. The particular shape of the impeller provides an especially effective bubble-shearing and bubble-dispersing action.

10 Claims, 1 Drawing Sheet

DISPERSING GAS INTO MOLTEN METAL

This application is a division of application Ser. No. 222,934, filed July 22, 1988, now U.S. Pat. No. 4,898,367.

BACKGROUND OF THE INVENTION

1. Field of the Invention

The invention relates to dispersing gas into molten metal and, more particularly, to techniques for causing finely divided gas bubbles to be dispersed uniformly throughout the molten metal.

2. Description of the Prior Art

In the course of processing molten metals, it sometimes is necessary to treat the metals with gas. For example, it is customary to introduce gases such as nitrogen and argon into molten aluminum and molten aluminum alloys in order to remove undesirable constituents such as hydrogen gas, non-metallic inclusions, and alkali metals. The gases added to the molten metal chemically react with the undesired constituents to convert them to a form (such as a precipitate or a dross) that can be separated readily from the remainder of the molten metal. In order to obtain the best possible results, it is necessary that the gas be combined with the undesirable constituents efficiently. Such a result requires that the gas be dispersed in bubbles as small as possible and that the bubbles be distributed uniformly throughout the molten metal.

As used herein, reference to "molten metal" will be understood to mean any metal such as aluminum, copper, iron, and alloys thereof, which are amenable to gas purification. Further, the term "gas" will be understood to mean any gas or combination of gases, including argon, nitrogen, chlorine, freon, and the like, that have a purifying effect upon molten metals with which they are mixed.

Heretofore, gases have been mixed with molten metals by injection through stationary members such as lances, or through porous diffusers. Such techniques suffer from the drawback that inadequate dispersion of the gas throughout the molten metal can occur. In order to improve the dispersion of the gas throughout the molten metal, it is known to stir the molten metal or otherwise convey it past the source of gas injection. Devices also are known that accomplish both of these functions, that is, the devices stir the molten metal while simultaneously injecting gas into the molten metal.

Despite the existence of combined stirring/injecting devices, certain problems remain. Combined stirring-/injecting devices often exhibit poor stirring action. Sometimes cavitation occurs or a vortex is established that moves around the inside of the vessel within which the molten metal is contained. Frequently these devices dispense bubbles that are too large or which are not uniformly distributed throughout the molten metal. A problem with one known prior device is that it utilizes an impeller having passageways that can be clogged with dross or foreign objects. Most of the prior devices are expensive, complex, and usable with only one type of molten metal-handling system. Other problems frequently encountered are poor longevity of the devices due to oxidation, erosion, or lack of mechanical strength. These latter concerns are particularly troublesome in the case of aluminum because the stirring/injecting devices usually are made of graphite, and graphite is rapidly oxidized and eroded by molten aluminum.

Accordingly, devices that initially perform adequately often become quickly oxidized and eroded so that their mixing and gas dispersing effectiveness diminishes rapidly; in severe cases, complete mechanical failure can occur.

SUMMARY OF THE INVENTION

The present invention provides a new and improved technique for dispersing gas within molten metal that overcomes the foregoing problems. Apparatus according to the invention includes an impeller in the form of a rectangular prism having upper and lower faces, a width (A), a depth (B), and a height (C), with (A) preferably being equal to (B). The impeller has a gas discharge outlet opening through the lower face of the prism. An elongate, rotatable shaft is rigidly connected to the impeller and projects from the upper face of the impeller. The apparatus also includes means for conveying gas to the gas discharge outlet, whereby gas to be dispersed into molten metal can be pumped along the lower face of the impeller.

In the preferred embodiment, the gas discharge outlet is defined by an opening extending through the upper and lower faces of the impeller, and the means for conveying gas to the gas discharge outlet is a longitudinally extending bore formed in the shaft, the shaft being connected to the impeller such that the bore in the shaft and the opening in the impeller are in fluid communication with each other. Desirably, the outer surface of the shaft and the inner surface of the opening in the impeller are threaded, and the shaft is connected to the impeller by threading the shaft into the opening.

The invention also includes a method for dispersing gas into molten metal that comprises the steps of providing an impeller, a shaft, and means for conveying gas as described previously, immersing the impeller into molten metal contained within a vessel, rotating the shaft about its longitudinal axis, and pumping gas through the gas discharge outlet while rotating the shaft so as to discharge gas along the lower face of the impeller. Large gas bubbles are sheared into finely divided bubbles by impact with the corners of the impeller. If the molten metal is contained within a vessel having an inner diameter D, the impeller is centered within the vessel and the ratio of A to D should be within the range of 1:6 to 1:8. Further, for an impeller and vessel having the foregoing dimensional relationships, the shaft should be rotated within the range of 200–400 revolutions per minute in order to obtain optimum mixing action.

By use of the present invention, the problems associated with prior devices are overcome. The apparatus according to the invention is inexpensive, easy to manufacture, and it has excellent longevity due to its inherently reliable, strong design. The device cannot be clogged with dross or foreign objects. It is usable with all types of molten metal handling and transport systems, and it has an excellent stirring and gas dispersal action that avoids problems such as cavitation and the creation of vortices. The gas is dispersed by way of finely divided bubbles that are uniformly mixed throughout the molten metal.

The foregoing and other features and advantages of the invention are illustrated in the accompanying drawings and are described in more detail in the specification and claims that follow.

DESCRIPTION OF THE PREFERRED EMBODIMENT

Figure 1:
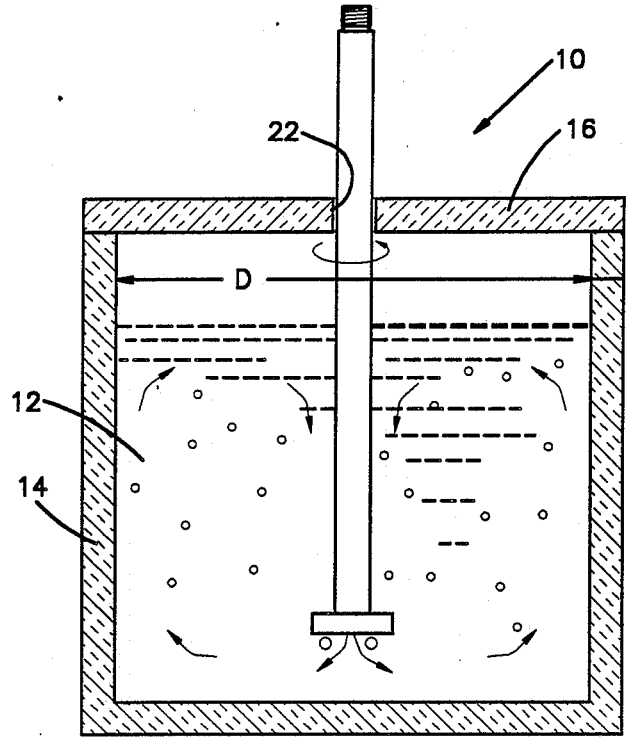
FIG. 1 is a cross-sectional view of a vessel containing molten metal into which gas dispersing apparatus has been immersed.
Figure 2:
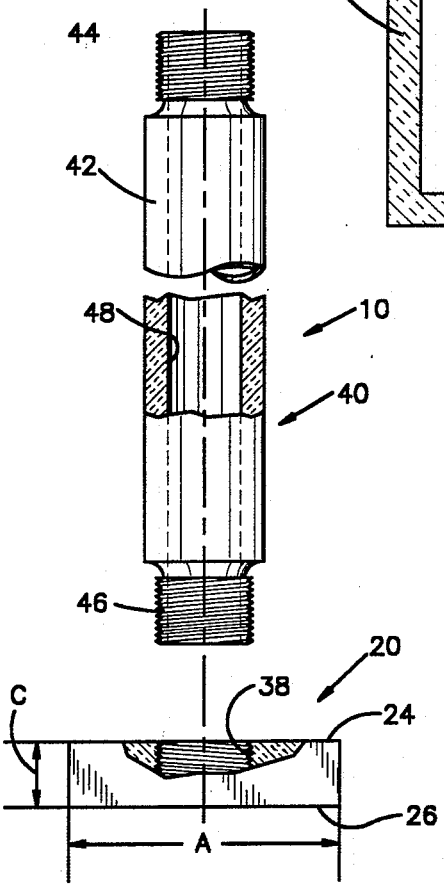
FIG. 2 is an enlarged view of the dispersing apparatus of FIG. 1, with an impeller and a shaft being illustrated in spaced relationship.
Figure 3:
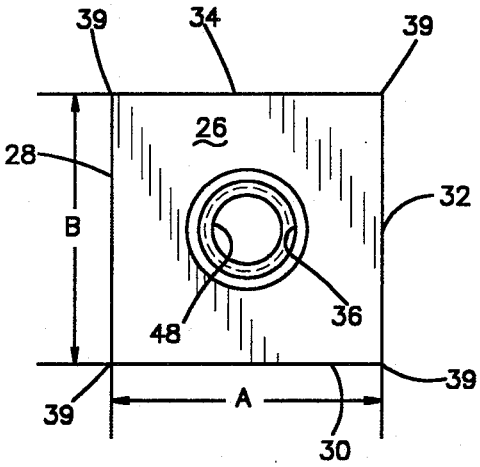
FIG. 3 is a bottom plan view of the impeller of FIG. 2.

Referring to FIGS. 1–3, a gas injection device according to the invention is indicated generally by the reference numeral 10. The device 10 is adapted to be immersed in molten metal 12 contained within a vessel 14. The vessel 14 is provided with a removable cover 16 in order to prevent excessive heat loss from the upper surface of the molten metal 12. The vessel 14 can be provided in a variety of configurations, such as cubic or cylindrical. For purposes of the present description, the vessel 14 will be described as cylindrical, with an inner diameter indicated by the letter D in FIG. 1. For non-cylindrical applications, the letter D will identify that dimension defining the average inner diameter of the vessel 14.

The apparatus 10 includes an impeller 20 and a shaft 40. The impeller 20 and the shaft 40 usually will be made of graphite, particularly if the molten metal being treated is aluminum. If graphite is used, it preferably should be coated or otherwise treated to resist oxidation and erosion. Oxidation and erosion treatments for graphite parts are practiced commercially, and can be obtained from sources such as Metaullics Systems, 31935 Aurora Road, Solon, Ohio 44139.

As is illustrated in FIG. 1, the shaft 40 is an elongate member that is rigidly connected to the impeller 20 and which extends out of the vessel 14 through an opening 22 provided in the cover 16. The impeller 20 is in the form of a rectangular prism having an upper face 24, a lower face 26, and side walls 28, 30, 32, 34. The impeller 20 includes a gas discharge outlet 36 opening through the lower face 26. In the preferred embodiment, the gas discharge outlet 36 constitutes a portion of a threaded opening 38 that extends through the impeller 20 and which opens through the upper and lower faces 24, 26. The faces 24, 26 are parallel with each other as are the side walls 28, 32 and the side walls 30, 34. The faces 24, 26 and the side walls 28, 30, 32, 34 are planar surfaces which define sharp, right-angled corners 39.

As shown in FIGS. 2 and 3, the side walls 30, 34 have a width identified by the letter A, while the side walls 28, 32 have a depth indicated by the letter B. The height of the impeller 20, that is, the distance between the upper and lower faces 24, 26, is indicated by the letter C. Preferably, dimension A is equal to dimension B, and dimension C is equal to $\frac{1}{3}$ dimension A. Deviations from the foregoing dimensions are possible, but best performance will be attained if dimensions A and B are equal to each other (the impeller 20 is square in plan view), and if the corners 39 are sharp and right-angled. Also, the corners 39 should extend perpendicular to the lower face 26 at least for a short distance above the lower face 26. As illustrated, corners 39 are perpendicular to the lower face 26 completely to their intersection with the upper face 24. It is possible, although not desirable, that the upper face 24 could be larger or smaller than the lower face 26 or that the upper face 24 could be skewed relative to the lower face 26; in either of these cases, the corners 39 would not be perpendicular to the lower face 26. The best performance is attained when the corners 39 are exactly perpendicular to the lower face 26. It also is possible that the impeller 20 could be triangular, pentagonal, or otherwise polygonal in plan view, but any configuration other than a rectangular, square prism exhibits reduced bubble-shearing and bubble-mixing performance.

The dimensions A, B, and C also should be related to the dimensions of the vessel 14, if possible. In particular, the impeller 20 has been found to perform best when the impeller 20 is centered within the vessel 14 and the ratio of dimensions A and D is within the range of 1:6 to 1:8. Although the impeller 20 will function adequately in a vessel 14 of virtually any size or shape, the foregoing relationships are preferred.

The shaft 40 includes an elongate, cylindrical center portion 42 from which threaded upper and lower ends 44, 46 project. The shaft 40 includes a longitudinally extending bore 48 that opens through the ends of the threaded portions 44, 46. The shaft 40 can be fabricated from a commercially available flux tube, or gas injection tube, merely by machining threads at each end of the tube. A typical flux tube suitable for use with the present invention has an outer diameter of 2.875 inches, a bore diameter of 0.75 inch, and a length dependent upon the depth of the vessel. As is illustrated in the Figures, the lower end 46 is threaded into the opening 38 until a shoulder defined by the cylindrical portion 42 engages the upper face 24. If desired, the shaft 40 could be rigidly connected to the impeller 20 by techniques other than a threaded connection, as by being cemented or pinned. A threaded connection is preferred due to its strength and ease of manufacture. The use of coarse threads ($4\frac{1}{2}$ inch pitch, UNC) facilitates manufacture and assembly.

The threaded end 44 is connected to a rotary drive mechanism (not shown) and the bore 48 is connected to a gas source (not shown). Upon immersing the impeller 20 in molten metal and pumping gas through the bore 48, the gas will be discharged through the opening 36 in the form of large bubbles that flow outwardly along the lower face 26. Upon rotation of the shaft 40, the impeller 20 will be rotated. Assuming that the gas has a lower specific gravity than the molten metal, the gas bubbles will rise as they clear the lower edges of the side walls 28, 30, 32, 34. Eventually, the gas bubbles will be contacted by the sharp corners 39. The bubbles will be sheared into finely divided bubbles which will be thrown outwardly and thoroughly mixed with the molten metal 12 which is being churned within the vessel 14. In the particular case of the molten metal 12 being aluminum and the treating gas being nitrogen or argon, the shaft 40 should be rotated within the range of 200–400 revolutions per minute. Because there are four corners 39, there will be 800–1600 shearing edge revolutions per minutes.

By using the apparatus according to the invention, high volumes of gas in the form of finely divided bubbles can be pumped through the molten metal 12, and the gas so pumped will have a long residence time. The apparatus 10 can pump gas at nominal flow rates of 1 to 2 cubic feet per minute (cfm), and flow rates as high as 4 to 5 cfm can be attained without choking. The apparatus 10 is very effective at dispersing gas and mixing it with the molten metal 12. The invention is exceedingly inexpensive and easy to manufacture, while being adaptable to all types of molten metal storage and transport systems. The apparatus 10 does not require accurately machined, intricate parts, and it thereby has greater resistance to oxidation and erosion, as well as enhanced mechanical strength. Because the impeller 20 and the shaft 40 present solid surfaces to the molten metal 12, there are no orifices or channels that can be clogged by dross or foreign objects.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A method for dispersing gas into molten metal, comprising the steps of:

providing an impeller in the form of a rectangular prism having upper and lower faces, a width (A), a depth (B), and a height (C), with (A) being equal to (B), the impeller having a gas discharge outlet opening through the lower face of the prism;

providing an elongate, rotatable a shaft rigidly connected to the impeller and projecting from the upper face of the impeller;

providing means for conveying gas to the gas discharge outlet;

providing a vessel within which molten metal is contained;

immersing the impeller into the molten metal contained within the vessel;

rotating the shaft about its longitudinal axis; and pumping gas through the gas discharge outlet while rotating the shaft.

2. The method of claim 1, wherein the gas discharge outlet is defined by an opening extending through the upper and lower faces of the impeller, and the means for conveying gas to the gas discharge outlet is a longitudinally extending bore formed in the shaft, the shaft being connected to the impeller such that the bore in the shaft and the opening in the impeller are in fluid communication with each other.

3. The method of claim 2, wherein the outer surface of the shaft and the inner of the opening in the impeller are threaded, and the shaft is connected to the impeller by threading the shaft into the opening.

4. The method of claim 1, wherein the shaft is connected to the impeller by means of a threaded connection.

5. The method of claim 1, wherein the shaft is connected to the impeller at the center of the upper face.

6. The method of claim 1, wherein the shaft is cylindrical.

7. The method of claim 1, wherein the impeller and the shaft are made of graphite.

8. The method of claim 1, wherein C equals $\frac{1}{3}$ A.

9. The method of claim 1, wherein molten metal is contained within a vessel having an inner diameter (D), the impeller is centered within the vessel, and the ratio of A to D is within the range of 1:6 to 1:8.

10. The method of claim 1, wherein the shaft is rotated within the range of 200–400 revolutions per minutes.

* * * * *